United States Patent [19]

Rizzo

[11] Patent Number: 4,767,234

[45] Date of Patent: Aug. 30, 1988

[54] HIGHWAY SEALANT APPLICATOR SYSTEM

[76] Inventor: Rudolph R. Rizzo, 1005 Thaxten La., Wilmington, Del.

[21] Appl. No.: 117,290

[22] Filed: Nov. 4, 1987

[51] Int. Cl.[4] ..... E01C 19/12

[52] U.S. Cl. ..... 404/111; 404/107; 404/110; 239/150; 118/108; 118/415

[58] Field of Search ..... 404/87, 94, 101, 105, 404/107, 108, 110, 111; 427/136, 138; 239/150, 172, 722, 754; 118/100, 108, 305, 415

[56] References Cited

U.S. PATENT DOCUMENTS

| | | | |
|---|---|---|---|
| 1,709,711 | 4/1929 | Duffy | 404/111 X |
| 1,860,271 | 5/1932 | Wenning | 404/107 X |
| 1,945,065 | 1/1934 | Mosslang et al. | 118/108 X |
| 2,530,777 | 11/1950 | Middlestadt | 404/107 |
| 2,578,080 | 12/1951 | Middlestadt | 404/107 |
| 2,964,245 | 12/1960 | Anderson et al. | 239/150 |
| 3,347,138 | 10/1967 | Lunde | 404/107 |
| 3,515,041 | 6/1970 | Murtaugh | 404/108 |
| 3,989,403 | 11/1976 | Verive | 404/111 |
| 4,315,700 | 2/1982 | Heiligtag et al. | 404/111 |
| 4,688,964 | 8/1987 | Cox | 404/111 X |

*Primary Examiner*—Jerome Massie
*Assistant Examiner*—John F. Letchford
*Attorney, Agent, or Firm*—Mortenson & Uebler

[57] ABSTRACT

Apparatus is provided for applying a sealing composition to a road surface. The apparatus includes supply means for the sealing composition and an applicator having a pressure chamber having adjustable-gap exit openings adjacent the road surface and having doctor blades which, when appropriately set, apply the composition to the road surface to a uniform and preset thickness across the width of the applicator. The apparatus includes means for propelling the applicator over a road surface.

4 Claims, 2 Drawing Sheets

28
18
20
33
15
14
32
36
25
19
16
38
21
22
12
52
60
50
26
24
35
10
31
41
37
39
30
34
43

HIGHWAY SEALANT APPLICATOR SYSTEM

BACKGROUND OF THE INVENTION

This invention relates to apparatus for applying a sealant composition to a road surface. It is now universally recognized that the service lives of highway pavements are greatly dependent on the ability to prevent water penetration through joints or cracks in the highway surface. This is especially critical for old roads needing maintenance. A technique gaining acceptance in this field is the application of an integral filler or membrane over the affected area. Not only is this approach cost and performance effective, but it serves to retard reflective cracking should the road be overlayed with bituminous concrete at a later date. Indeed, in some states, e.g., Pennsylvania, the hot extrusion of a fiberized membrane over the joints or cracks prior to rehabilitation paving is a standard specification. Critical parameters for such membranes are their width and thickness. Current applicators used for this purpose can not accurately control either the thickness or width of the applied composition. Moreover, ability to apply the membrane in a reasonably straight line is difficult.

SUMMARY OF THE INVENTION

Apparatus for applying a sealing composition to a road surface is provided comprising inlet means for supplying a sealing composition, the inlet means leading to an applicator comprising two rigid longitudinal vertical side walls, each having a leading edge and a trailing edge, the side walls being separated by and affixed to two rigid vertical end walls, one end wall affixed to the leading edges of the side walls and one end wall affixed to the trailing edges of the side walls, each end wall having a vertically adjustable flexible doctor blade affixed to it extending across the width of the end wall and extending downwardly beyond the lower edge of the end wall, the applicator having a pressure chamber formed therein comprising two vertically adjustable rigid transverse inner walls affixed to a transverse top bracket, the top bracket affixed at either end to the side walls, the inner walls and top bracket extending transversely between the side walls and being located between the end walls, the top bracket having an opening therein and being connected to the inlet means via valve means. Means are affixed to the apparatus for propelling the apparatus over a road surface. The apparatus has means for adjusting the spacing between the lower edge of the side walls and the road surface. When the spacing between the lower edge of the side walls and the road surface is set at a desired distance, and when the sealing composition is supplied to the applicator, the composition is applied to the road surface to a uniform thickness across the width of the applicator as the apparatus is propelled over the road surface. The means for propelling the apparatus may be a wand and the means for adjusting the spacing between the lower edge of the side walls and the road surface may comprise vertically adjustable rails affixed to each side wall. Alternatively, the means for propelling the apparatus may be a wheeled cart having a handle and having spring-loading means affixed to the cart for forcing the applicator downardly.

DETAILED DESCRIPTION OF THE INVENTION AND PREFERRED EMBODIMENTS WITH REFERENCE TO THE DRAWINGS

Apparatus is provided for applying a sealing composition to a road surface. The apparatus includes supply means for the sealing composition and an applicator having a pressure chamber having adjustable-gap exit openings adjacent the road surface and having doctor blades which, when appropriately set, apply the composition to the road surface to a uniform and preset thickness across the width of the applicator. The apparatus includes means for propelling the applicator over a road surface.

Key features of the applicator are: (1) a pressure chamber to effect penetration of sealant into the joint or crack; (2) two open reservoirs (one each for forward and backward motions) for uniformly dispersing the sealant; and (3) flexible, leveling squeegees.

Figures 1, 2, 3, 4:
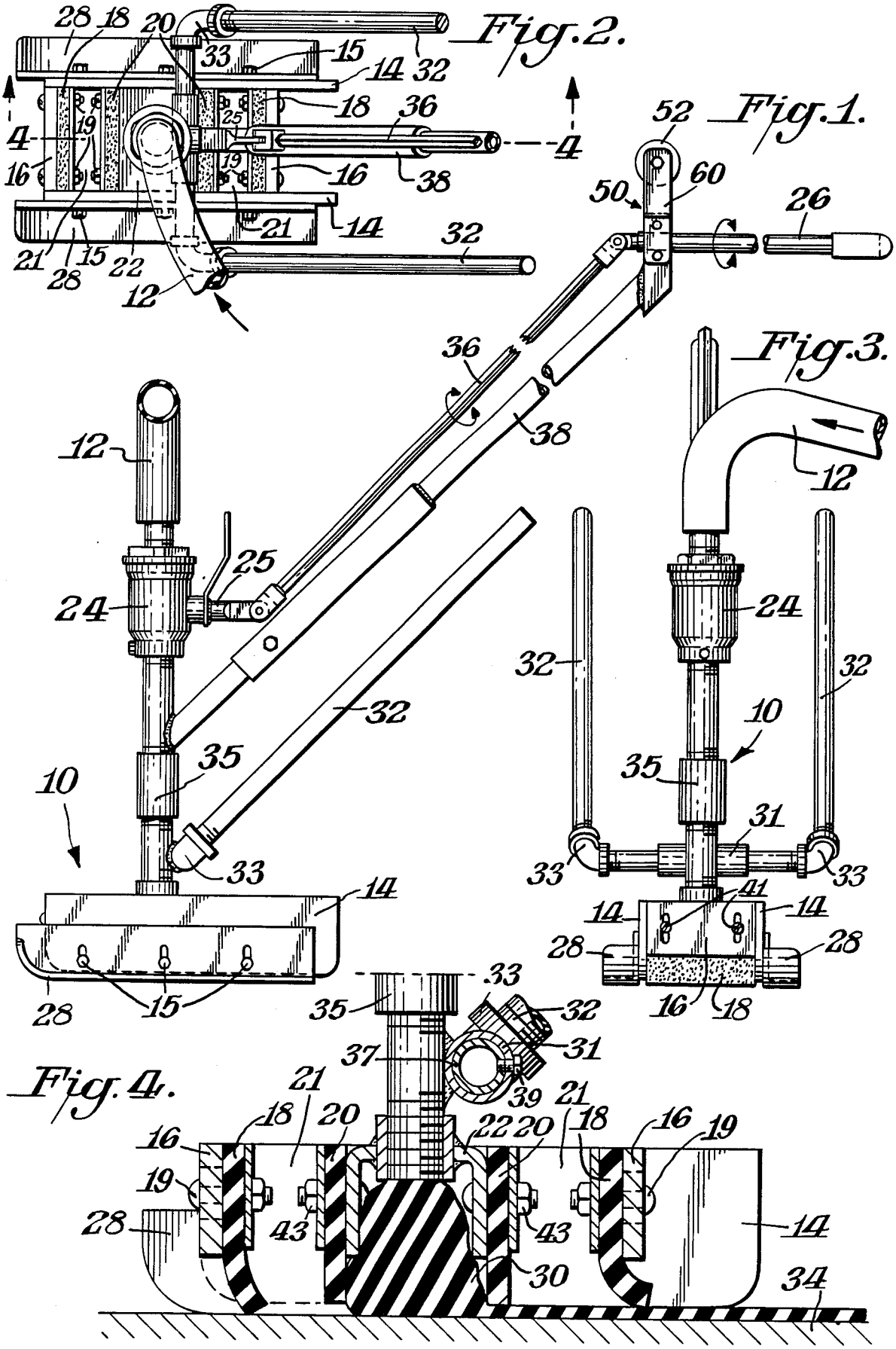
FIG. 1 is a side elevational view of one embodiment of the apparatus of the invention.
FIG. 2 is a top plan view of the apparatus shown in FIG. 1.
FIG. 3 is a front elevation of the apparatus as shown in FIG. 1
FIG. 4 is a cross-sectional view taken substantially along line 4—4 of FIG. 2.

A detailed description of the invention is best provided with reference to the drawings, wherein FIG. 1 is a side elevational view of one embodiment of the apparatus of the invention. Applicator apparatus 10 includes inlet tube or hose 12 for introducing sealant composition from a reservoir, not shown. The flow of the composition into the applicator is controlled by adjustable valve means 25. The applicator has side walls 14 affixed to rails 28. The distance between the bottom edges of side walls 14 and the road surface is adjustable as desired by setting bolts 15 at the desired height in their respective slots. The conduit connector and sealant supply piping 35 convey sealant composition from the supply line 12 into the pressure chamber in applicator 10, to be described more fully below. The applicator may be guided by hand by means of wand or handle 38 and upper gripping means 50, shown in detail in FIG. 5. The rotatable grip 52 may be used to propel the applicator 10 backwards or forewards and the handle 26, which is rotatable as indicated by the arrows, is used to control the opening of valve 25 which controls the volume of sealant composition flowing to the applicator. Connector 33 and piping 32 are especially useful when the applicator is employed in conjunction with a wheeled cart, to be described more fully below.

As further illustrated in the top plan view shown in FIG. 2, apparatus 10 includes inlet means 12 for directing sealant composition into the apparatus as indicated by the arrow. Side walls 14 are connected to end walls 16 as shown. Doctor blades 18 are affixed to end walls 16 by means of bolts and nuts 19. The doctor blades 18 extend transversely across the width of applicator 10 between the side walls 14. The transverse inner walls 20 which are bolted to top bracket 22 together form the pressure chamber of the applicator which is described in detail below. Open reservoirs 21 allow for accumulation of excess sealing composition. Valve means 25 controlled by valve adjustment shaft 36 permit the operator to adjust the volume of flow of sealant which enters the pressure chamber of the apparatus. Rails 28 which are affixed to side walls 14 are vertically adjustable by means of bolts 15. The "U" bracketing consisting of cross-connecting member 31, connectors 33 and piping 32 are especially useful when the applicator is used in conjunction with a wheeled cart, to be described further below. Main guide shaft or wand 38 is shown for completeness.

FIG. 3 shows a front-elevation of applicator 10 showing side walls 14 affixed to end wall 16 with doctor blade 18 extending downwardly to the road surface. Side walls 14 are affixed to slide rails 28 as shown. Supply piping 35 and conduit connector 24 convey sealant composition from inlet means 12 into the pressure chamber of applicator 10. Connecting member 31, which is affixed to supply piping 35, forms a "U" bracket with connectors 33 and pipes 32, and is described more fully below.

FIG. 4 is a cross-sectional view of the applicator 10 taken along line 4-4 of FIG. 2. As shown, side wall 14 is affixed to front and back end walls 16. Doctor blades 18, which extend downwardly from end walls 16 beyond the lower edges of end walls 16 as shown, are affixed to the end walls 16 by means of nuts and bolts 19. A pressure chamber is formed in applicator 10 in the space formed by inner walls 20 and "U" channel 22 which extend transversely across the applicator between side walls 14. Inner walls 20 are affixed to the bracket 22 by means of nuts and bolts 43. Doctor blades 18 and side walls 20 are preferably of a hard rubber such as neoprene. The gap distance between the bottom edges of side walls 20 and the road surface 34 is adjustable by means of vertical adjustment of bolts 43 which are set in their respective vertical slots, not shown, similar to bolts 15. The preferred gap distances are in the range of one-thirty second to one-sixteenth inch. The bracketing formed by pipes 32, connectors 33 and cross-member 31 is affixed to the supply piping 35 as shown and is adjusted to the desired angle, preferably 45 degrees, by means of collar 37 and bolt 39. The applicator as shown is moving from right to left. Sealant composition 30, which is preferably a fiberized sealant, e.g. "Fiber Pave" as manufactured by and commercially available from Hercules, Inc., Wilmington, Del., flows from supply piping 35 into the pressure chamber formed by inner walls 20 and bracket 22. A portion of the sealant 30 is extruded through the gap between the lower edge of wall 20 and the road surface 34. Excess accumulation can collect in open reservoirs 21. As sealant 30 exits the applicator, it is smoothed to a final, uniform thickness across the width of the applicator by doctor blade 18.

Figure 5:
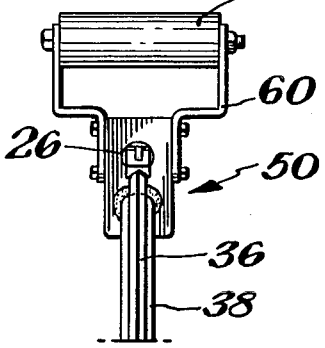
FIG. 5 is a front elevation of the upper, handle portion of the apparatus shown in FIG. 1.

FIG. 5 shows the upper gripping means 50 comprising wand 38 affixed to bracket 60, with valve handle and valve control 26 extending therethrough. Rotatable grip 52 is used to propel the applicator forward and backward.

Figure 6:
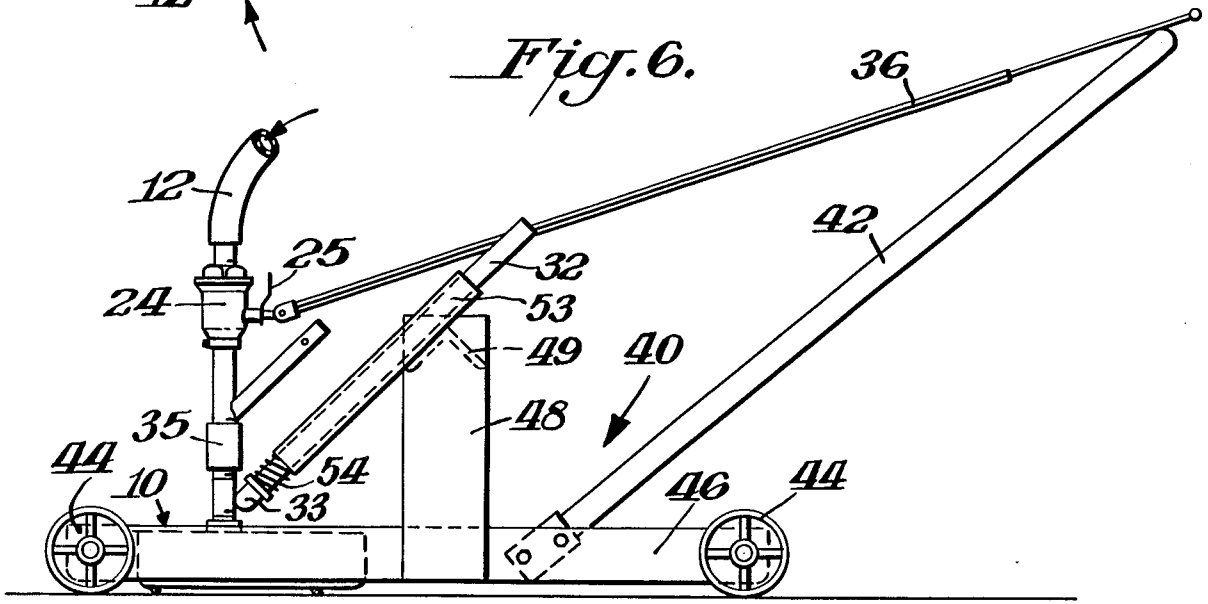
FIG. 6 is a side elevational view of an alternate embodiment of the invention.

FIG. 6 is a side elevation of the applicator of the invention 10 used in connection with a wheeled cart 40. As shown, applicator 10 is supported within the frame 46 of cart 40 by means of brackets 48 and 49. Vertical bracket 48 is affixed to cart frame 46 and transverse bracket 49 is affixed to brackets 48 on both sides of cart 40. Tubes or sleeves 53 are affixed to transverse bracket 49. The pipes 32 in the "U" bracket formed by pipes 32, connectors 33 and cross-member 31 extend through the sleeves 53. Springs 54 placed between the bottom end of sleeves 53 and the upper end of connectors 33 tend to force the applicator 10 downwardly and aid in providing a uniform covering thickness of sealant. Handle 42 is used to move the cart 40 over the road surface on wheels 44. Valve control shaft 36 is used to adjust the flow of sealant through inlet 12 by adjusting valve 25 as before.

Figure 7:
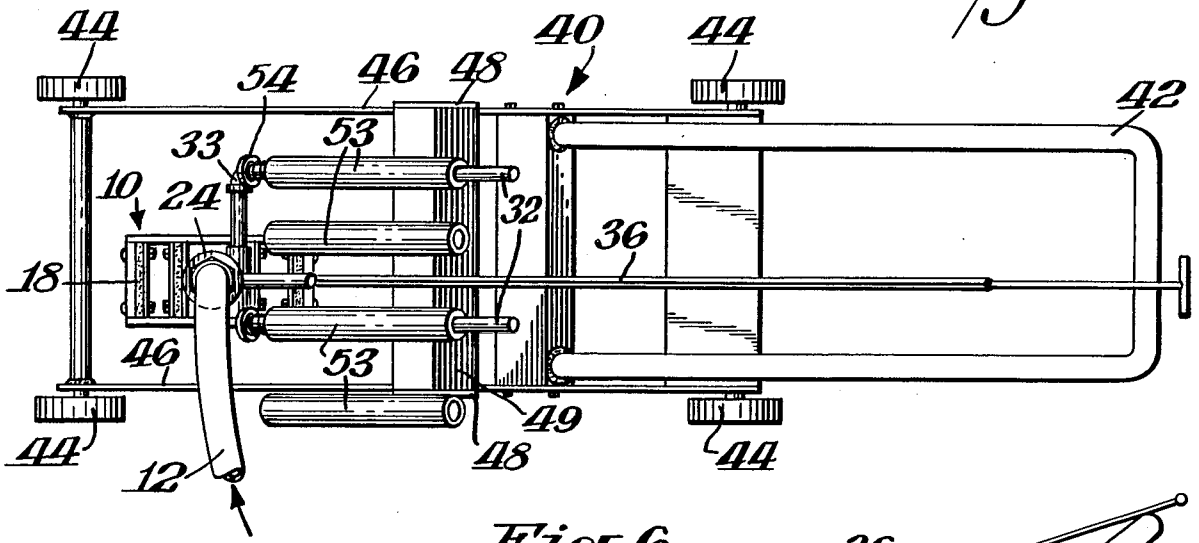
FIGS. 7 and 8 are top plan and front elevational views, respectively, of the embodiment of the invention depicted in FIG. 6.

FIG. 7 is a top plan view of the applicator and cart in combination. Applicator 10 is supported in cart 40 which rides on wheels 44. The piping 32 extends through two of the sleeves 53. Four sleeves 53 are preferred to provide for transverse adjustability of the applicator 10 in cart 40. Springs 54 tend to force the applicator 10 downwardly as discussed above.

Figure 8:
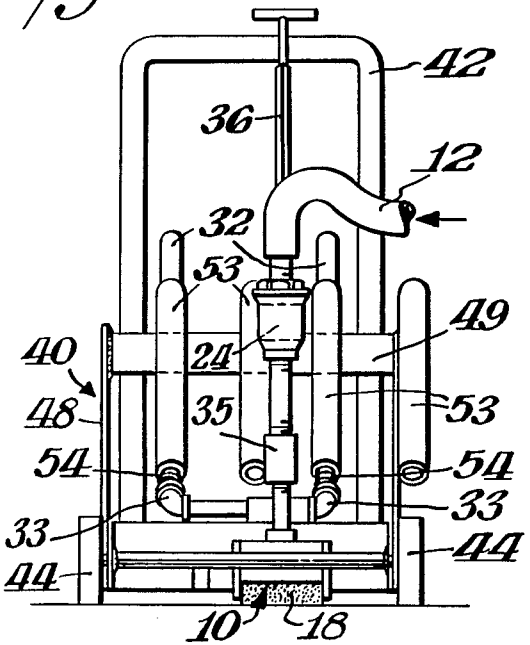

FIG. 8 is a front elevational view of the applicator 10 of the invention used in conjunction with the wheeled cart 40. The width of appliator 10 may be as desired for a particular job. Preferably the width ranges from four to twelve inches, but other widths may be employed.

While the invention has been disclosed herein in connection with certain embodiments and detailed descriptions, it will be clear to one skilled in the art that modifications or variations of such details can be made without deviating from the gist of this invention, and such modifications or variations are considered to be within the scope of the claims hereinbelow.

What is claimed is:

1. Apparatus for applying a sealing composition to a road surface comprising:

inlet means for supplying said composition leading to an applicator comprising two rigid longitudinal vertical side walls, each having a leading edge and a trailing edge, said side walls separated by and affixed to two rigid vertical outer end walls, one end wall affixed to said leading edges of said side walls and one end wall affixed to said trailing edges of said side walls, each said end wall having a vertically adjustable flexible doctor blade affixed to it extending across the width of said end wall and extending downwardly beyond the lower edge of said end wall, said applicator having a pressure chamber formed therein comprising two vertically adjustable rigid transverse inner walls affixed to a transverse top bracket, the top bracket affixed at either end to said side walls, said inner walls and top bracket extending transversely between said side walls and being located between said end walls, said top bracket having an opening therein and being connected to said inlet means via valve means, and means affixed to said apparatus for propelling said apparatus over a road surface, said apparatus having means for adjusting the spacing between the lower edge of said side walls and said road surface, whereby, when said spacing between the lower edge of said side walls and said road surface is set at a desired distance, thereby setting the gap between the road surface and the lower edges of said rigid transverse inner walls to a desired distance, and when the sealing composition is supplied to said applicator, the composition is applied to the road surface to a uniform thickness across the width of said applicator.

2. The apparatus of claim 1 wherein said means for propelling said apparatus is a wand and said means for adjusting the spacing between the lower edge of said side walls and said road surface comprise vertically adjustable rails affixed to each said side wall.

3. The apparatus of claim 1 wherein said means for propelling said apparatus is a wheeled cart having a handle and brackets for supporting said applicator, and having spring-loading means affixed to said cart for forcing said applicator downwardly.

4. The apparatus of claim 1 wherein said valve means are adjustable.

* * * * *